US006032737A

United States Patent [19]

Brady et al.

[11] Patent Number: 6,032,737

[45] Date of Patent: Mar. 7, 2000

[54] METHOD AND SYSTEM FOR INCREASING OIL PRODUCTION FROM AN OIL WELL PRODUCING A MIXTURE OF OIL AND GAS

[75] Inventors: Jerry L. Brady; Mark D. Stevenson; John M. Klein; James L. Cawvey; David D. Hearn, all of Anchorage, Ak.

[73] Assignee: Atlantic Richfield Company, Los Angeles, Calif.

[21] Appl. No.: 09/056,272

[22] Filed: Apr. 7, 1998

[51] Int. Cl.[7] ..... E21B 43/38

[52] U.S. Cl. ..... 166/265; 166/266

[58] Field of Search ..... 166/265, 266, 166/267, 268, 169, 306, 106

[56] References Cited

U.S. PATENT DOCUMENTS

| | | | |
|---|---|---|---|
| 4,378,047 | 3/1983 | Elliott et al. | 166/68 |
| 4,531,584 | 7/1985 | Ward | 166/265 |
| 4,531,593 | 7/1985 | Elliott et al. | 175/71 |
| 4,610,793 | 9/1986 | Miller | 210/767 |
| 4,896,725 | 1/1990 | Parker et al. | 166/267 |
| 4,981,175 | 1/1991 | Powers | 166/265 |
| 4,995,456 | 2/1991 | Cornette et al. | 166/51 |
| 5,074,357 | 12/1991 | Haines | 166/267 |
| 5,343,945 | 9/1994 | Weingarten et al. | 166/105.5 |
| 5,385,446 | 1/1995 | Hays | 415/202 |
| 5,431,228 | 7/1995 | Weingarten et al. | 166/357 |
| 5,450,901 | 9/1995 | Ellwood | 166/266 |
| 5,482,117 | 1/1996 | Kolpak et al. | 166/265 |
| 5,605,193 | 2/1997 | Bearden et al. | 166/370 |
| 5,730,871 | 3/1998 | Kennedy et al. | 210/512.2 |
| 5,794,697 | 8/1998 | Wolflick et al. | 166/265 |

FOREIGN PATENT DOCUMENTS

| | | | |
|---|---|---|---|
| 48912 | 12/1989 | WIPO | 166/267 |

OTHER PUBLICATIONS

"New Design for Compact Liquid–Gas Partial Separation: Downhole and Surface Installations for Artificial Lift Applications" by J.S. Weingarten, M.M. Kolpak, S.A. Mattison and M.J. Williamson, SPE 30637, Society of Petroleum Engineers, 1995.

"Development and Testing of a Compact Liquid–Gas Auger Partial Separator for Downhole or Surface Applications" by J.S. Weingarten, M.M. Kolpak, S.A. Mattison and M.J. Williamson, Society of Petroleum Engineers, 1997.

"Slim Phase 4™", Sperry–Sun Drilling Services, 1994, 1995.

"New Design Expands Success of Slim Phase 4™ MWD Resistivity Tool", Real–time—Slim Phase 4™, Sperry Sun Drilling Services, Fall 1995.

"Improved Production Log Interpretation in Horizontal Wells Using Pulsed Neutron Logs", by J.L. Brady, J.J. Kohring and R.J. North, SPE 36625, Society of Petroleum Engineers, 1996.

Glossary of Terms & Expressions Used in Well Logging, Second Edition, Society of Professional Well Log Analysis, Oct., 1984.

"Jet Pumping" by Hal Petrie, Chapter 6 of "The Technology of Artificial Lift Methods"—vol. 2b.

*Primary Examiner*—William Neuder
*Attorney, Agent, or Firm*—F. Lindsey Scott

[57] ABSTRACT

A method and system for increasing oil production from an oil well producing a mixture of oil and gas at an elevated pressure through a wellbore penetrating an oil-bearing formation containing an oil-bearing zone and an injection zone, by separating at least a portion of the gas from the mixture of oil and gas to produce a separated gas and an oil-enriched mixture; utilizing energy from at least a portion of the mixture of oil and gas to compress at a surface at least a portion of the separated gas to produce a compressed gas having sufficient pressure to be injected into the injection zone; injecting the compressed gas into the injection zone; and recovering at least a major portion of the oil-enriched mixture.

33 Claims, 8 Drawing Sheets

METHOD AND SYSTEM FOR INCREASING OIL PRODUCTION FROM AN OIL WELL PRODUCING A MIXTURE OF OIL AND GAS

FIELD OF THE INVENTION

This invention relates to a method for increasing oil production from oil wells producing a mixture of oil and gas it an elevated pressure through a wellbore penetrating an oil bearing formation containing an injection zone and an oil bearing zone by separating a portion of the gas from the mixture, utilizing energy from at least a portion of the mixture to compress at a surface the separated gas, and injecting the compressed gas into the injection zone.

BACKGROUND OF THE INVENTION

In many oil fields the oil bearing formation comprises a gas cap zone and an oil bearing zone. Many of these fields produce a mixture of oil and gas with the gas to oil ratio (GOR) increasing as the field ages. This is a result of many factors well known to those skilled in the art. Typically the mixture of gas and oil is separated into an oil portion and a gas portion at the surface. The gas portion may be marketed as a natural gas product, injected to maintain pressure in the gas cap or the like. Further, many such fields are located in parts of the world where it is difficult to economically move the gas to market therefore the injection of the gas preserves its availability as a resource in the future as well as maintaining pressure in the gas cap.

Wells in such fields may produce mixtures having a GOR of over 10,000 standard cubic feet per standard barrel (SCF/STB). In such instances, the mixture may be less than 1% liquids by volume in the well. Typically a GOR from 800 to 2,500 SCF/STB is more than sufficient to carry the oil to the surface as a gas/oil mixture. Normally the oil is dispersed as finely divided droplets or a mist in the gas so produced. In many such wells quantities of water may be recovered with the oil. The term "oil" as used herein refers to hydrocarbon liquids produced from a formation. The surface facilities for separating and returning the gas to the gas cap obviously must be of substantial capacity when such mixtures are produced to return sufficient gas to the gas cap or other depleted formations to maintain oil production.

Typically, in such fields, gathering lines gather the fluids into common lines which are then passed to production facilities or the like where crude oil, condensate, and other hydrocarbon liquids are separated and transported as crude oil. Natural gas liquids are then recovered from the gas stream and optionally combined with the crude oil and condensate. Optionally, a miscible solvent which comprises carbon dioxide, nitrogen and a mixture of light hydrocarbons such as the gas stream may be used for enhanced oil recovery or the like. The remaining gas stream is then passed to a compressor where it is compressed for injection. The compressed gas is injected through injection wells, an annular section of a production well, or the like, into the gas cap.

Clearly the size of the surface equipment required to process the mixture of gas and oil is considerable and may become a limiting factor on the amount of oil which can be produced from the formation because of capacity limitations on the ability to handle the produced gas.

It has been disclosed in U.S. Pat. No. 5,431,228 "Down Hole Gas-Liquid Separator for Wells" issued Jul. 11, 1995 Weingarten et al and assigned to Atlantic Richfield Company that an auger separator can be used downhole to separate a gas and liquid stream for separate recovery at the surface. A gaseous portion of the stream is recovered through an annular space in the well with the liquids being recovered through a production tubing.

In SPE 30637 "New Design for Compact Liquid-Gas Partial Separation: Down Hole and Surface Installations for Artificial Lift Applications" by Weingarten et al it is disclosed that auger separators as disclosed in U.S. Pat. 5,431,228 can be used for downhole and surface installations for gas/liquid separation. While such separations are particularly useful as discussed for artificial or gas lift applications and the like, all of the gas and liquid is still recovered at the surface for processing as disclosed. Accordingly, the surface equipment for processing gas may still impose a significant limitation on the quantities of oil which can be produced from a subterranean formation which produces oil as a mixture of gas and liquids.

Accordingly a continuing search has been directed to the development of methods which can increase the amount of oil which may be produced from subterranean formations producing a mixture of oil and gas with existing surface equipment.

SUMMARY OF THE INVENTION

According to the present invention, it has been found that increased quantities of oil can be produced from an oil well producing a mixture of oil and gas at an elevated pressure through a wellbore penetrating an oil-bearing formation containing an oil-bearing zone and an injection zone, by separating at least a portion of the gas from the mixture of oil and gas to produce a separated gas and an oil-enriched mixture; utilizing energy from at least a portion of the mixture of oil and gas to compress at a surface at least a portion of the separated gas to produce a compressed gas having sufficient pressure to be injected into the injection zone; injecting the compressed gas into the injection zone; and recovering at least a major portion of the oil-enriched mixture.

The invention further comprises a system for increasing oil production from an oil well producing a mixture of oil and gas at an elevated pressure through a wellbore penetrating a formation containing an oil-bearing zone and an injection zone, wherein the system comprises a separator in fluid communication with the oil-bearing zone; turbine positioned on the surface and having an inlet in fluid communication with the separator; and a compressor positioned on the surface, the compressor being drivingly connected to the turbine and having a gas inlet in fluid communication with a separated gas discharge outlet on the separator, the compressor further having a compressed gas discharge outlet in fluid communication through a passageway with the injection zone.

DESCRIPTION OF THE PREFERRED EMBODIMENTS

In the discussion of the Figures, the same numbers will be used to refer to the same or similar components throughout. Certain components of the wells necessary for the proper operation of the wells, and certain pumps, valves, and compressors necessary to achieve proper flow of fluids, have not been discussed in the interest of conciseness.

Figure 1:
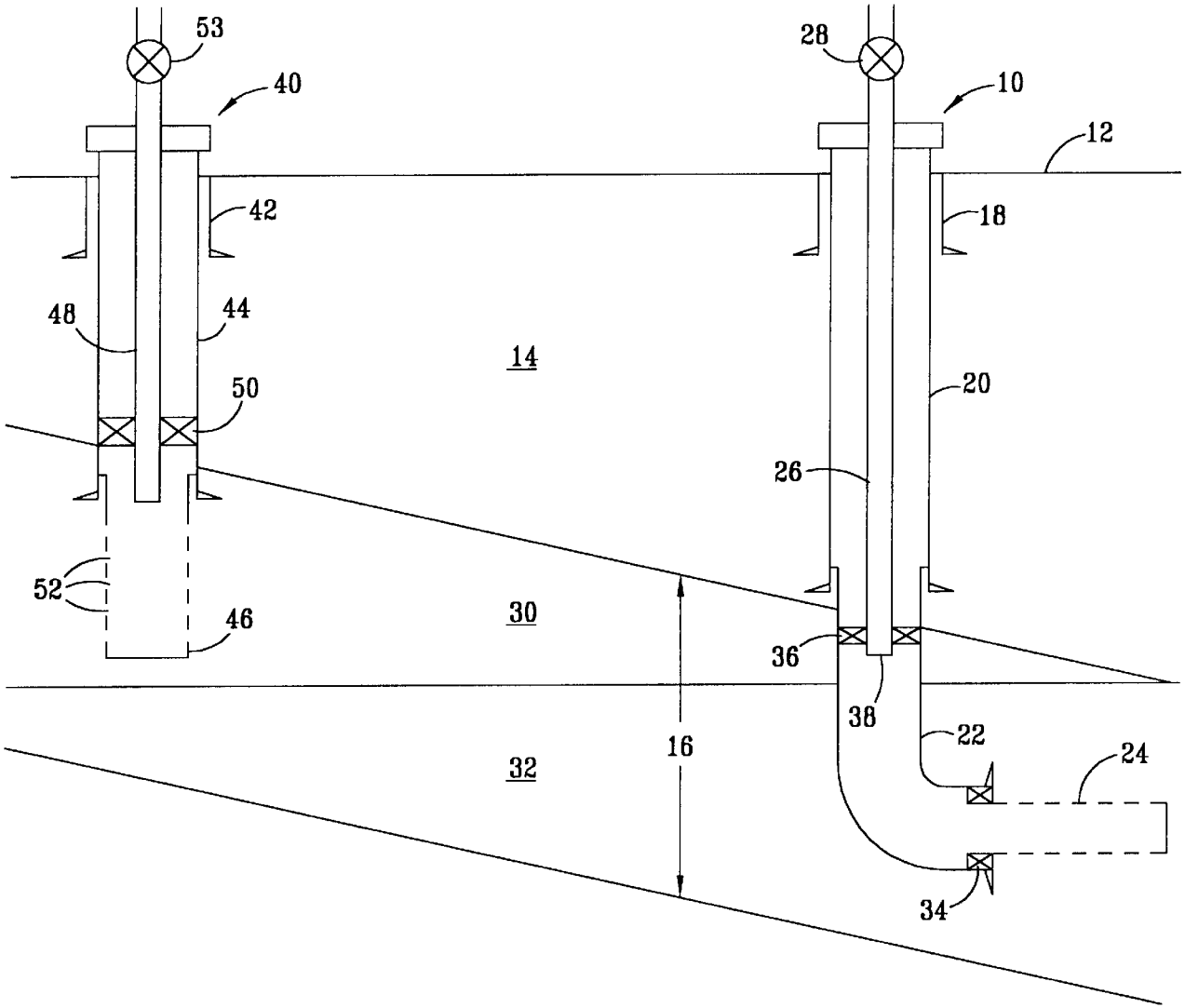
FIG. 1 PRIOR ART
FIG. 1 is a schematic diagram of a production well, according to the prior art, for producing a mixture of oil and gas from a subterranean formation and an injection well for injecting gas back into a gas cap in the oil bearing formation.

In FIG. 1, depicting the prior art, a production oil well 10 is positioned in a wellbore (not shown) to extend from a surface 12 through an overburden 14 to an oil bearing formation 16. The production oil well 10 includes a first casing section 18, a second casing section 20, a third casing section 22, and a fourth casing section 24, it being understood that the oil well may alternatively include more or fewer than four casing sections. The use of such casing sections is well known to those skilled in the art for the completion of oil wells. The casings are of a decreasing size and the fourth casing 24 may be a slotted liner, a perforated pipe, or the like. While the production oil well 10 is shown as a well which has been curved to extend horizontally into the formation 16, it is not necessary that the well 10 include such a horizontal section and, alternatively, the well 10 may extend only vertically into the formation 16. Such variations are well known to those skilled in the art for the production of oil from subterranean formations.

The oil well 10 also includes a tubing string referred to herein as production tubing 26 for the production of fluids from the well 10. The production tubing 26 extends upwardly to a wellhead 28 shown schematically as a valve. The wellhead 28 contains the necessary valuing and the like to control the flow of fluids into and from the oil well 10, the production tubing 26, and the like.

The formation 16 includes a selected injection zone 30 and an oil bearing zone 32 underlying the injection zone 30. The selected injection zone 30 may be a gas cap zone, an aqueous zone, an upper portion of the oil bearing zone 32, a depleted portion of the formation 16, or the like. Pressure in the formation 16 is maintained by gas in the injection zone 30 and, accordingly, it is desirable in such fields to maintain the pressure in the injection zone as hydrocarbon fluids are produced from the formation 16 by injecting gas. The formation pressure may be maintained by water injection, gas injection, or both. The injection of gas requires the removal of the liquids from the gas prior to compressing the gas, and injecting the gas back into the injection zone 30. Typically, the GOR of oil and gas mixtures recovered from such formations increases as the level of the oil bearing zone drops as a result of the removal of oil from the oil bearing formation 16.

In the well 10, a packer 34 or a nipple with a locking mandrel or the like is used to prevent the flow of fluids in the annular space between the third casing section 22 and the fourth casing section 24. A packer 36 is positioned to prevent the flow of fluids in the annular space between the exterior of the production tubing 26 and the interior of the second casing section 20 and that portion of the interior of the third casing section 22 above the packer 36. Fluids from the formation 16 can thus flow upwardly through the production tubing 26 and the wellhead 28 to processing equipment (not shown) at the surface, as described previously. The well 10, as shown, produce fluids under the formation pressure and does not require a pump.

Also shown in FIG. 1 is an injection well 40 comprising a first casing section 42, a second casing section 44, a third casing section 46, and an injection tubing 48. A packer 50 is positioned between the interior of the casing 44 and the exterior of the tubing 48 to prevent the upward flow of fluid between the tubing 48 and the casing 44. Gas is injected into the injection zone 30 through perforations 52 in the third casing section 46. The flow of gases into the well 40 is regulated by a wellhead 53 shown schematically as a valve.

In operation, gas produced from the well 10 is injected into the injection zone 30 through the injection well 40. The injected gas thereby maintains pressure in the formation 16 and remains available for production and use as a fuel or other resource at a later date if desired.

In oil wells which produce excessive amounts of gas, the necessity for handling the large volume of gas at the surface can limit the ability of the formation to produce oil. The installation of sufficient gas handling equipment to separate the large volume of gas from the oil filter use as a product, or for injection into the injection zone 30 can be prohibitively expensive.

Figure 2:
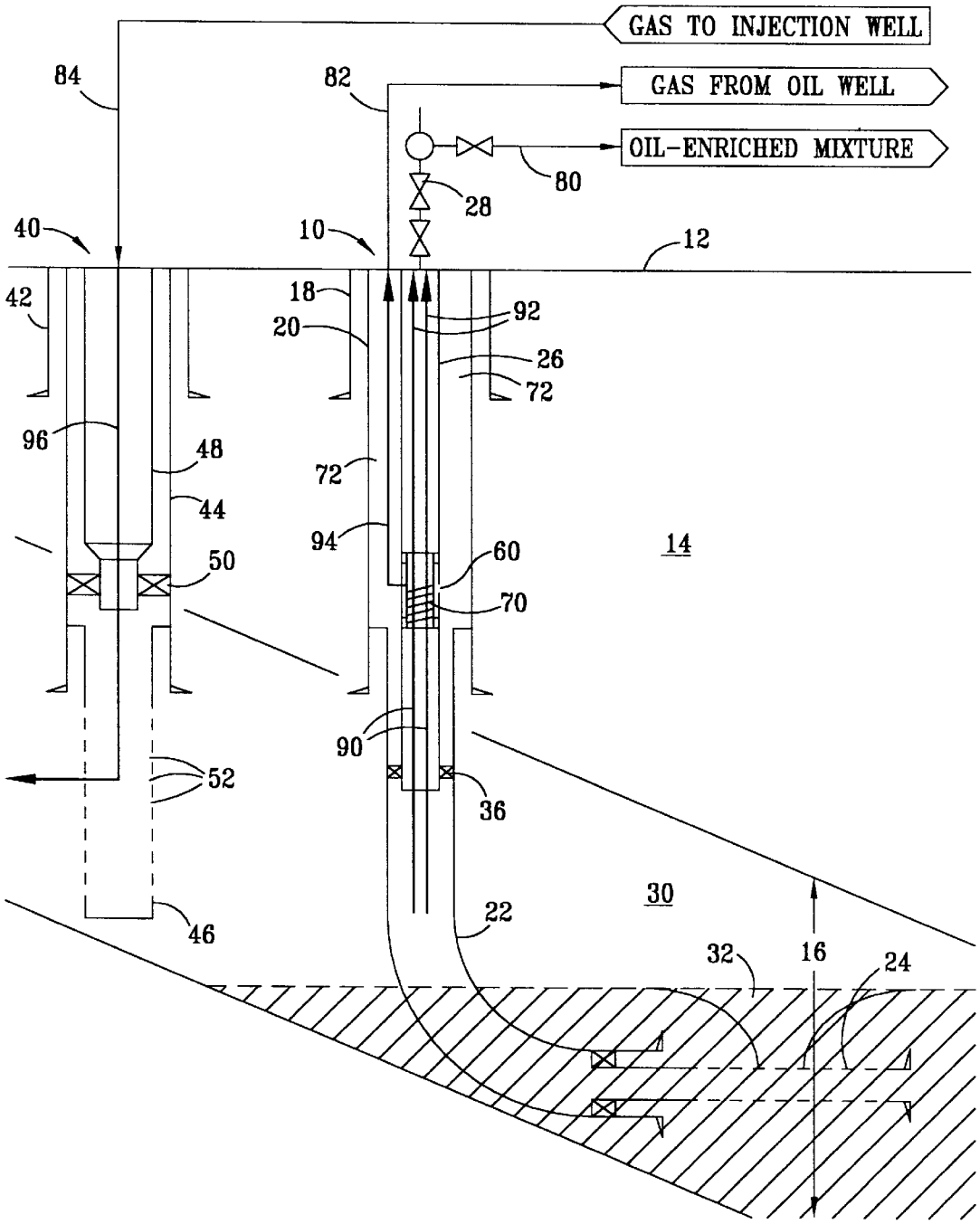
FIG. 2 is a schematic diagram of a downhole portion of an embodiment of the system of the present invention in which gas is separated downhole from liquids in a formation, produced through a production well to a surface where it is compressed, and injected through a dedicated injection well back into a gas cap in the formation.

In FIG. 2, an embodiment of a downhole portion of the present invention is shown which permits the downhole separation and injection of at least a portion of the produced gas, and which permits the production of an oil-enriched mixture of oil and gas. An embodiment of a surface portion of the present invention, which surface portion is complementary to the downhole portion, is described below with respect to FIGS. 6–10 in which surface facilities compress gas separated in the downhole portion of the present invention before the gas is injected using the downhole portion.

The embodiment shown in FIG. 2 comprises a modification of the production oil well 10 in which a perforated or punched orifice, opening, or hole, such as the hole 60, is formed in the production tubing 26 in a manner well known to those skilled in the art. The hole 60 may optionally include a valve (not shown), such as a gas lift valve, a check valve, a hole insert, or the like, positioned therein for controlling the flow of fluids therethrough. A downhole separator 70 is positioned within the production tubing 26 so that a gas discharge outlet (not shown) on the separator is aligned with the hole 60 for discharge therethrough. The separator 70 may be any of a number of different types of separators, such as an auger separator, a cyclone separator, a rotary centrifugal separator, or the like. Auger separators and the positioning of them in production tubing are more fully disclosed and discussed in U.S. Pat. No. 5,431,228, "Down Hole Gas Liquid Separator for Wells", issued Jul. 11, 1995 to Jean S. Weingarten et al, and in "New Design for Compact-Liquid Gas Partial Separation: Down Hole and Surface Installations for Artificial Lift Applications", lean S. Weingarten et al, SPE 30637 presented Oct. 22–25, 1995, both of which references are hereby incorporated in their entirety by reference. Such separators and the positioning of them downhole are considered to be well known to those skilled in the art and are effective to separate at least a major portion of the gas from a flowing stream of liquid (e.g., oil) and gas by causing the fluid mixture to flow around a circular path thereby forcing heavier phases, i.e., the liquids, outwardly by centrifugal force and upwardly into the production tubing 26 for recovery at the surface 12. The lighter phases of the mixture, i.e., the gases, are displaced inwardly within the separator 70, away from the heavier phases, and are thereby separated from the liquids, and flow from the separator 70 through the separator gas outlet, the hole 60, and upwardly through an annulus 72, formed between the second casing section 20 and the production tubing 26, to the surface 12

As shown schematically in FIG. 2, an oil-enriched mixture line 80 and a gas line 82 are connected for providing fluid communication between the wellhead 28 and the annulus 72, respectively, and surface facilities configured for compressing the gas as will be described more fully below with respect to FIGS. 6–10. A gas return line 84 is connected for providing fluid communication between a discharge outlet of surface facilities and the injection tubing 48.

In the operation of the system shown in FIG. 2, a mixture of oil and gas (which may also include other liquids, such as water) flows from the oil-bearing formation 32 through the fourth and third casing sections 24 and 22, respectively, into the production tubing 26, and into the separator 70, as shown schematically by arrows 90. The separator 70 separates at least a portion of the gas from the mixture of oil and gas in the oil well 10 to produce a separated gas and an oil-enriched mixture. As shown schematically by arrows 92, the oil-enriched mixture produced by the separator 70 is discharged upwardly into the production tubing 26 and through the wellhead 28 and the oil-enriched mixture line 80 to surface facilities described below. As shown schematically by an arrow 94, the separated gas is discharged from the separator 70 through the hole 60 into the annulus 72. The separated gas then flows upwardly through the annulus 72 and the gas line 82 to surface facilities, described below, which compress the gas to a pressure sufficient to permit the gas to be injected into the injection zone 30, such pressure being referred to hereinafter as an "injection pressure". The gas compressed to the injection pressure by the surface facilities is discharged from the surface facilities through the gas return line 84 into the injection tubing 48 in the well 40, as shown schematically by an arrow 96, and into the injection zone 30. As a result of head pressure and friction losses which are incurred as the gas is injected downhole, the foregoing injection pressure preferably exceeds the pressure of the gas in the injection zone 30, less the head pressure of the gas in the injection tubing 48, plus pressure loss incurred from friction as the gas is injected downhole.

While only one well 10 is depicted in FIG. 2, a plurality of wells similar to the well 10 may produce gas which is compressed by surface facilities and injected through the dedicated injection well 40 into the injection zone 30.

In an alternate embodiment of the system shown in FIG. 2, the separator 70 may be provided with a cross-over device (not shown), well known to those skilled in the art, to direct separated gas from the separator to the production tubing 26 rather than the annulus 72, and to direct the oil-enriched mixture from the separator to the annulus 72 rather than the production tubing 26. The oil-enriched mixture line 80 would then be connected in fluid communication with the annulus 72 rather than the production tubing 26, and the gas line 82 would be connected in fluid communication with the production tubing 26 rather than the annulus 72. Operation of such an alternate embodiment would otherwise be substantially similar to the operation of the embodiment shown in FIG. 2.

By the use of the system shown in FIG. 2, a portion of the gas is separated downhole from the oil/gas mixture and, as a result, the separated gas incurs less head loss and less friction loss and, therefore, maintains a substantially higher pressure as it is produced to the surface, than it would if it were produced in combination with the oil/gas mixture. The downhole separation of the gas from the oil/gas mixture also relieves the load on surface facilities to separate gas from the oil/gas mixture. In many fields, it is not uncommon to encounter GOR values as high as 10,000 SCF/STB. GOR values from 800 to 2,500 SCF/STB are generally more than sufficient to carry the produced liquids to the surface. A significant amount of the gas can thus be separated downhole with no detriment to the production process. This significantly increases the amount of oil which can be recovered from formations which produce gas and oil in mixture which are limited by the amount of gas handling capacity available at the surface. Additionally, the system of FIG. 2 facilitates the measurement of the gas separation efficiency and of the composition of gas injected downhole.

Figure 3:
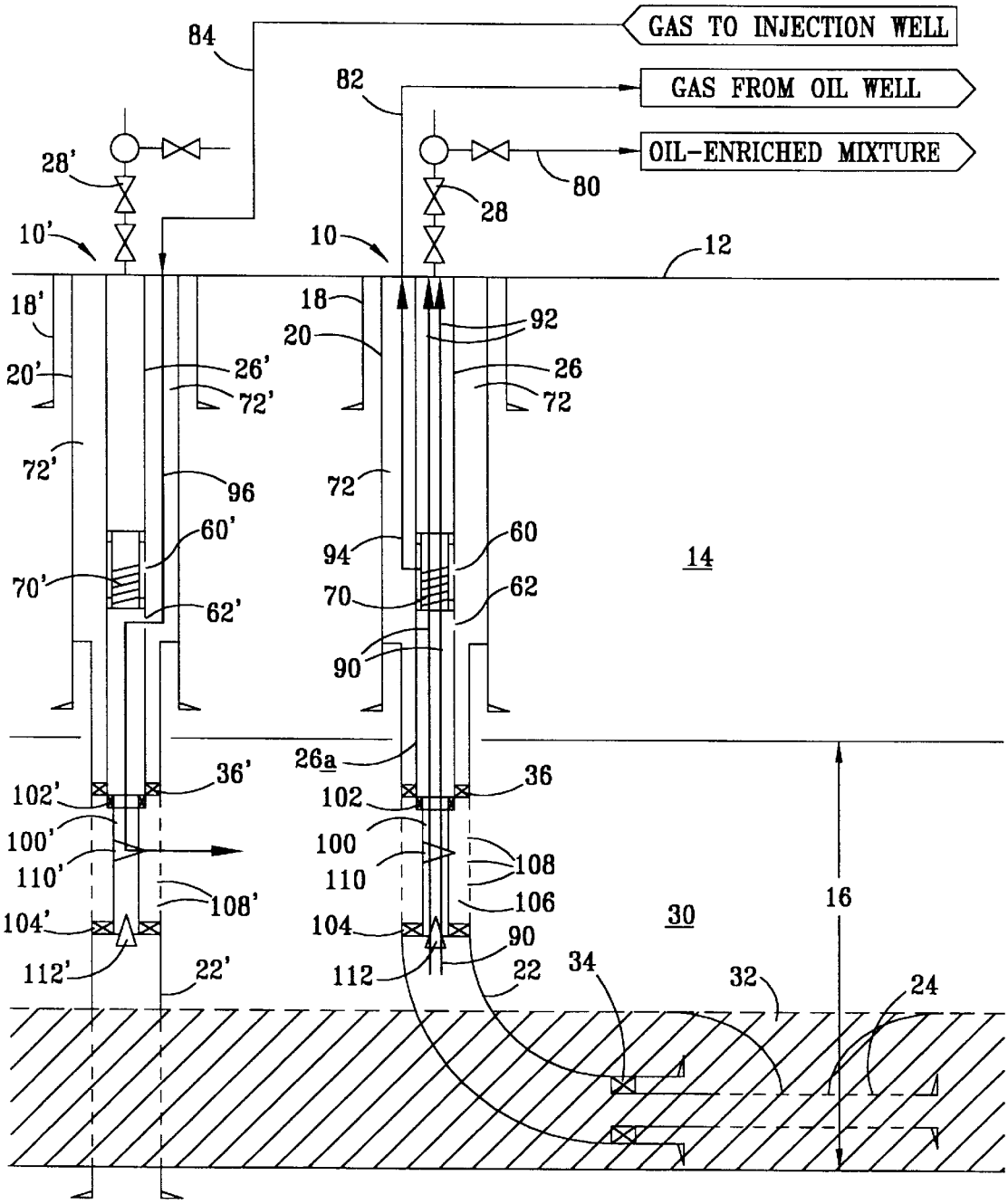
FIG. 3 is a schematic diagram of a downhole portion of a portion of an alternate embodiment of the system of the present invention in which gas is separated downhole from liquids in a formation, produced through a production well to a surface where it is compressed, and injected through another production well, acting as an injection well, back into a gas cap in the formation.

In FIG. 3, an alternate embodiment of the system of FIG. 2 is shown. An additional hole 62, similar to the hole 60, is perforated, punched, or otherwise formed in the production tubing below the separator 70 and a valve (not shown), such as a gas lift valve, a check valve, a hole insert, or the like, is positioned therein for controlling the flow of fluids therethrough in a manner well known in the art. A tubing tail extension 100 is set in a lower end **26*a* of the production tubing 26. A packer 102 is positioned between the tubing tail extension 100 and the production tubing 26 to prevent fluid communication therebetween, and a packer 104 is interposed between the tubing tail extension 100 and the third casing section 22 to prevent fluid communication therebetween. A confined annular space 106 is thus defined between the tubing tail extension 100 and the third casing section 22 and between the packers 36, 102, and 104. The third casing section 22 is perforated with perforations 108 to provide fluid communication between the injection zone 30 and the annular space 106. The tubing tail extension 100 is fitted with a first check valve 110 suitably positioned to permit fluid to flow only from the tubing tail extension 100 to the annular space 106 and, therefore, to prevent contra flow. The tubing tail extension 100** is fitted with a second check valve 112 suitably positioned to permit fluid to flow only from that portion of the third casing 22 below the packer 104 to the tubing tail extension 100 and, therefore, to prevent contra flow. The positioning of the tubing tail extension 100, the packers 102 and 104, and the check valves 110 and 112 is considered to be well known to those skilled in the art and therefore will not be discussed further.

As further shown in FIG. 3, in place of the well 40 (FIG. 2) is a well 10' which is substantially identical to the well 10, except for its location in the formation 16. All components of the well 10' are identified by the same reference numerals as the components of the well 10, except that the reference numerals for the well 10' are primed. Because of the substantial similarity of the wells 10 and 10', no further discussion of the well 10' is considered necessary. It is noted though that the gas return line 84 is connected in fluid communication with the annulus 72' of the well 10'.

In the operation of the system shown in FIG. 3, in which the well 10 is operable as a production well and the well 10' is operable as an injection well, a mixture of oil and gas flows from the oil-bearing formation 32 through fourth and third casing sections 24 and 22, respectively, through the second check valve 112 and the tubing tail extension 100, into the production tubing 26, and into the separator 70, as shown schematically by the arrows 90. The valve positioned in the hole 62 prevents the mixture of oil and gas from flowing through the hole 62 into the annulus 72. The separator 70 separates at least a portion of the gas from the mixture of oil and gas in the oil well to produce a separated gas and an oil-enriched mixture. As shown schematically by the arrows 92, the oil-enriched mixture produced by the separator 70 is discharged upwardly into the production tubing 26 and through the wellhead 28 and the oil-enriched mixture line 80 to the surface facilities described below. As shown schematically by the arrow 94, separated gas is discharged from the separator 70 through the hole 60 into the annulus 72. The separated gas then flows upwardly through the annulus 72 and the gas line 82 to surface facilities which compress the gas to the injection pressure, defined above. As shown schematically by the arrow 96, compressed gas is discharged from the surface facilities through the gas return line 84 into the annulus 72' of the well 10' and through the hole 62' into the production tubing 26'. The gas in the production tubing 26' flows through the tubing tail extension 100', the check valve 110', and into the injection zone 30; and the check valve 112' prevents the flow of the gas into the oil-bearing formation 32.

While only one well 10 and only one well 10' is depicted in FIG. 3, one or more wells similar to the well 10 may produce gas which is compressed by surface facilities and injected through one or more wells similar to the injection well 10' into the injection zone 30. Furthermore, wells may alternately be used as production wells and, during their production off-cycles, as injection wells. For example, the well 10 shown in FIG. 3 may be used as an injection well during its production off-cycle while the well 10' is used as a production well which produces gas which is injected into the well 10.

In an alternate embodiment of the system shown in FIG. 3, the separators 70 and 70' may be provided with a cross-over device (not shown), well known to those skilled in the art, to direct separated gas from the separator to the production tubing 26 or 26' rather than the annulus 72 or 72', and to direct the oil-enriched mixture from the separator to the annulus 72 or 72' rather than the production tubing 26 or 26'. The oil-enriched mixture line 80 would then be connected in fluid communication with the annulus 72 rather than the production tubing 26, and the gas line 82 would be connected in fluid communication with the production tubing 26 rather than the annulus 72. Operation of such an alternate embodiment would otherwise be substantially similar to the operation of the embodiment shown in FIG. 3.

By the use of the system shown in FIG. 3, not only is a portion of the gas separated downhole from the oil/gas mixture, and the gas pressure thereby substantially maintained, and the measurement of the separation efficiency and injection gas composition facilitated as with the system of FIG. 2 but, additionally, the system of FIG. 3 does not require a dedicated injection well to inject gas downhole. The system of FIG. 3 permits production wells to be utilized more efficiently since they may be used as injection wells during their production offcycle.

Figure 4:
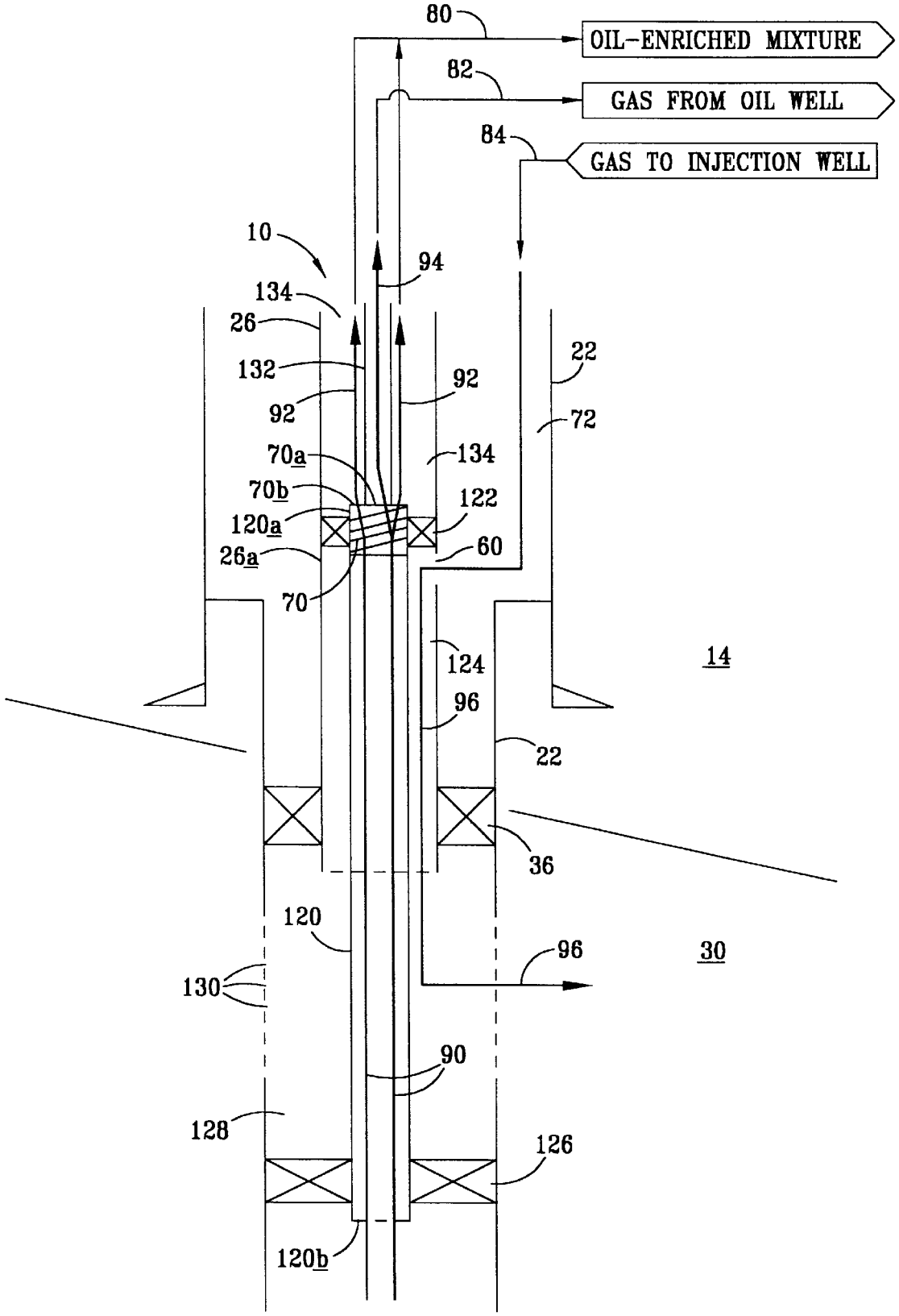
FIG. 4 is a schematic diagram of a downhole portion of an alternate embodiment of the system of the present invention in which gas is separated downhole from liquids in a formation, produced through a production well to a surface where it is compressed, and injected through an annulus of the production well back into a gas cap in the formation.

In FIG. 4, a modified portion of an alternate embodiment of the system of FIG. 2 is shown. The separator 70 is positioned in a tubular member 120 positioned in a lower end 26*a* of the production tubing 26. The positioning of tubular members by wire line operations or coiled tubing is well known to those skilled in the art and will not be discussed. A packer 122 or a nipple with a locking mandrel or the like is positioned above the hole 60, and between an upper end 120*a* of the tubular member 120 and the production tubing 26 to control the flow of fluids through a "straddle-by-tubing" annulus 124 defined between the tubular member 120 and that portion of the production tubing 26 extending below the packer 122. A packer 126 is positioned below the packers 36 and 122 between a lower end 120*b* of the tubular member 120 and the third casing section 22 to control the flow of fluids in a confined annular space 128 defined between the tubular member 120 and the third casing section 22 and between the packers 36, 122, and 126. The third casing section 22 is perforated with perforations 130 to provide fluid communication between the injection zone 30 and the annular space 128. A coiled tubing 132 is positioned in this production tubing 26 for providing fluid communication between a gas outlet 70*a* of the separator 70 and a gas line 82 to surface facilities described below. A "coil-by-tubing" annulus 134 defined between the production tubing 26 and the coiled tubing 132 provides fluid communication between an oil-enriched mixture outlet 70*b* of the separator 70 and the oil-enriched mixture line 80 to surface facilities. The gas return line 84 is connected in fluid communication between the surface facilities and the annulus 72 (referred to, with respect to FIG. 4, as a "tubing-by-casing" annulus) for carrying to the annulus 72 compressed gas for injection into the formation 16.

In the operation of the system shown in FIG. 4, a mixture of oil and gas flows from the oil-bearing formation 32 through the fourth and third casing sections 24 and 22 (FIG. 2), respectively, into the tubular member 120 and into the separator 70, as shown schematically by the arrows 90. The separator 70 separates at least a portion of the gas from the mixture of oil and gas in the oil well to produce a separated gas and an oil-enriched mixture. As shown schematically by the arrows 92, the oil-enriched mixture produced by the separator 70 is discharged upwardly through the outlet 70*b*, the coil-by-lubing annulus 134, the wellhead 28 (FIG. 2), and the oil-enriched mixture line 80 to surface facilities described below. As shown schematically by the arrow 94, the separated gas produced by the separator 70 is discharged upwardly through the gas outlet 70*a*, the coiled tubing 132, the gas line 82, and to surface facilities which compresses the gas to the injection pressure, defined above. Compressed gas is discharged from the surface facilities through the gas return line 84 into the tubing-by-casing annulus 72. As shown schematically by the arrow 96, compressed gas in the tubing-by-casing annulus 72 is ported through the hole 60 into and through the straddle-by-tubing annulus 124, the annular space 128, the perforations 130, and into the injection zone 30.

In an alternate embodiment of the system shown in FIG. 4, the separator 70 may be provided with a cross-over device (not shown), well known to those skilled in the art, to direct separated gas from the separator to the annulus 134 rather than the tubing 132, and to direct the oil-enriched mixture from the separator to the tubing 132 rather than the annulus 134. The oil-enriched mixture line 80 would then be connected in fluid communication with the tubing 132 rather than the annulus 134, and the gas line 82 would be connected in fluid communication to the annulus 134 rather than the tubing 132. Operation of such an alternate embodiment would otherwise be substantially similar to the operation of the embodiment shown in FIG. 4.

In a further alternate embodiment of the system shown in FIG. 4, the system may be configured without the tubular member 120, the packers 122 and 126, and the hole 60 by replacing the packer 126 with the packer 36 and extending the production tubing 26 to and through the packer 36. Operation of such an alternate embodiment is substantially similar to the operation of the embodiment shown in FIG. 4, except that the mixture of oil and gas flows through the production tubing 26 without flowing through the tubular member 120, and compressed gas flows through the annulus 72 to the injection zone 30 without flowing through the hole 60 and through the annulus 124.

By the use of the system shown in FIG. 4, not only is a portion of the gas separated downhole from the oil/gas mixture, and the gas pressure maintained, and the measurement of the separation efficiency and injection gas composition facilitated as with the system of FIG. 2 but, additionally, the system of FIG. 4 does not require an additional well to inject gas downhole and, thus, does not require a significant quantity of piping and valves at the surface to interconnect various wells.

Figure 5:
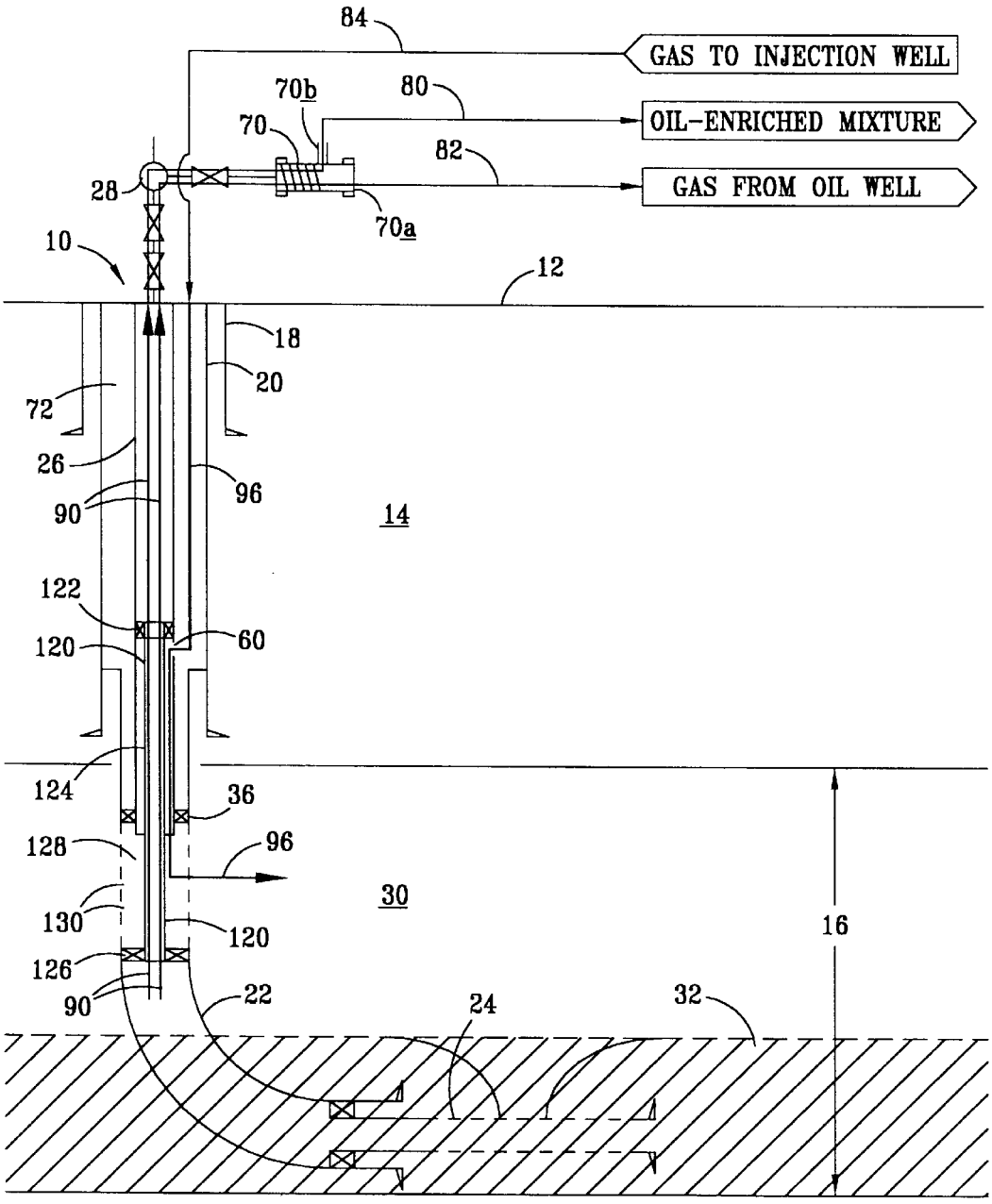
FIG. 5 is a schematic diagram of a downhole portion of an alternate embodiment of the system of the present invention in which gas is separated at a surface from liquids produced from a formation, compressed, and injected through the production well back into a gas cap in the formation.

In FIG. 5, an alternate embodiment of the system of FIG. 4 is shown in which the separator 70 is positioned at the surface 12. Because there is no downhole separation of the gas from the oil and gas produced, no coiled tubing is run down the production tubing 26 as there was in the system of FIG. 4. The system shown in FIG. 5 is otherwise substantially similar to the system shown in FIG. 4.

Operation of the system of FIG. 5 is similar to the operation of the system of FIG. 4 except that oil and gas produced from the formation 16 is separated by the separator 70 positioned at the surface 12. Thus the arrows 90 represent the flow of a mixture of oil and gas from the oil-bearing formation 32 through fourth and third casing sections 24 and 22, respectively, through the tubular member 120 and the production tubing 26, and into the separator 70 located at the surface 12. The separator 70 separates at least a portion of the gas from the mixture of oil and gas in the oil well to produce a separated gas an an oil-enriched mixture. The oil-enriched mixture produced by the separator 70 is discharged through the outlet 70*b* into the oil-enriched mixture line 80 to surface facilities described below. Separated gas produced by the separator 70 is discharged through the gas outlet 70*a* and the gas line 82 to surface facilities which compress the gas to the injection pressure, defined above. Compressed gas is discharged from the surface facilities through the gas return line 84 into the annulus 72. As shown schematically by the arrow 96, compressed gas in the annulus 72 is ported through the hole 60 into and through the annulus 124, the annular space 128, the perforations 130, and into the injection zone 30.

In an alternate embodiment of the system shown in FIG. 5, the system may be configured without the tubular member 120, the packers 122 and 126, and the hole 60 by replacing the packer 126 with the packer 36 and extending the production tubing 26 to and through the packer 36. Operation of such an alternate embodiment is substantially similar to the operation of the embodiment shown in FIG. 5, except that the mixture of oil and gas flows through the production tubing 26 without flowing through the tubular member 120, and compressed gas flows through the annulus 72 to the injection zone 30 without flowing through the hole 60 and through the annulus 124.

By the use of the system shown in FIG. 5, the separator 70 is more accessible than it was in the foregoing systems described, no coiled tubing is required, and the well 10 permits wireline tools to pass therethrough. As with the foregoing systems, the separation efficiency and injection gas composition may be measured. Furthermore, an additional well is not required to inject gas downhole. Thus, a significant quantity of piping and valves is not required at the surface to interconnect various wells.

In FIGS. 6–10, five embodiments of a surface portion of the present invention are shown in which gas, after it has been separated and before it is injected downhole, is compressed using surface facilities referenced in the foregoing discussion of embodiments of the downhole portion of the present invention shown in FIGS. 2–5. As stated previously, the surface portion of the present invention is complementary to the downhole portion and, in the following discussion, the embodiments of the surface portion are to be understood as connected through the oil-enriched mixture line 80, the gas line 82, and the gas return line 84 to any one of the embodiments of the downhole portion described with respect to FIGS. 2–5.

Figure 6:
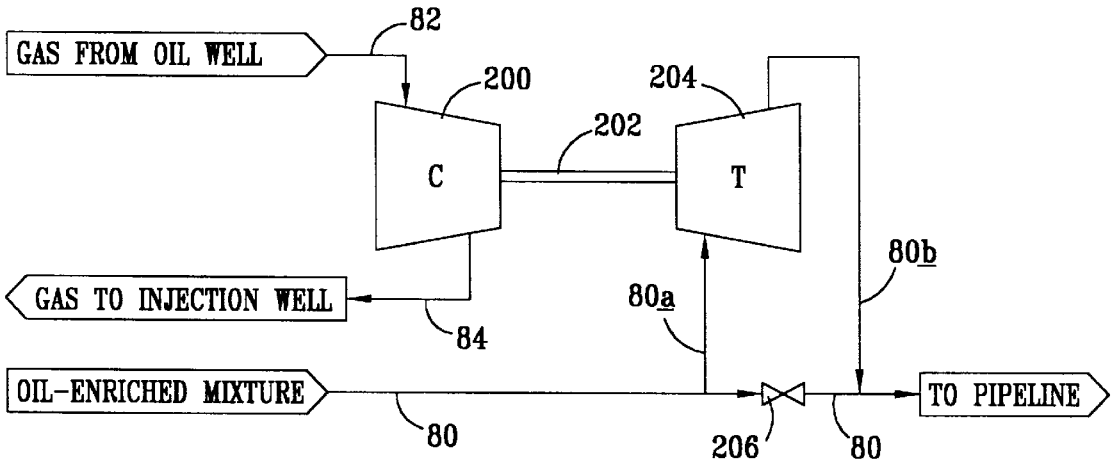
FIG. 6 is a schematic flow diagram of a surface portion of an alternate embodiment of the system of the present invention for compressing gas using energy from an oil-enriched mixture of oil and gas.

The embodiment of the surface portion of the present invention shown in FIG. 6 comprises a suitable compressor 200 drivingly connected through a shaft 202 to a suitable turbine 204. The compressor 200 is connected to the gas line 82 for receiving gas therethrough, and to the gas return line 84 for discharging gas thereto. The compressor 200 may be an axial, radial, or mixed-flow compressor, or the like, configured for compressing gas received through the gas line 82 to the injection pressure, defined above, and for discharging compressed gas to the gas return line 84. Compressors such as the compressor 200 are considered to be well known to those skilled in the art and will not be discussed further.

The turbine 204 is connected in parallel with the oil-enriched mixture line 80 for receiving through a line 80*a*, and for being driven by, at least a portion of the oil-enriched mixture flowing through the oil-enriched mixture line 80, and for discharging the received mixture through a line 80*b* to the oil-enriched mixture line 80. A suitable valve 206 is positioned in the oil-enriched mixture line 80 between the line 80*a* and 80*b* for controlling the amount of the oil-enriched mixture which flows through the turbine 204. The turbine 204 may be a radial or axial turbine such as a turbine expander, a hydraulic turbine, a bi-phase turbine, or the like. Turbine expanders, hydraulic turbines, and bi-phase turbines are considered to be well known to those skilled in the art, and are effective for receiving a stream of fluids, such as the oil-enriched mixture in the present invention, and for generating, from the received stream of fluids, torque exerted onto a shaft, such as the shaft 202, such stream of fluids comprising largely gases, liquids, and mixtures of gases and liquids, respectively. Bi-phase turbines, in particular, are more fully disclosed and discussed in U.S. Pat. No. 5,385,446, entitled "Hybrid Two-Phase Turbine", issued Jan. 31, 1995, to Lance G. Hays, which reference is hereby incorporated in its entirety by reference.

In the operation of the system shown in FIG. 6, if the valve 206 is open, then the oil-enriched mixture flows through the oil-enriched mixture line 80, generally bypassing the turbine 204, to a pipeline (not shown) which carries the mixture to downstream processing facilities (not shown) which are considered to be well known in the art and will not be discussed. When the turbine 204 is bypassed by the oil-enriched mixture as a result of the valve 206 being open, the turbine 204 does not drive the compressor 200 and gas in the gas line 82 is not compressed and cannot be injected into the formation 16 (not shown). If the valve 206 is closed, then all of the oil-enriched mixture flowing through the oil-enriched mixture line 80 also flows through the line 80*a* to and through the turbine 204, and through the line 80*b* to the pipeline (not shown) which carries the mixture to downstream processing facilities. As the mixture flows through the turbine 204, rotational motion is imparted to the turbine which then imparts rotational motion to the shaft 202 and drives the compressor 200. The compressor 200 receives gas through the gas line 82 and, as the compressor rotates, it compresses the gas received from the line 82 to the injection pressure, defined above. Compressed gas is discharged from the compressor 200 into the gas return line 84 and into the injection zone 30 (FIGS. 2–5) as discussed above. The valve 206 may be only partially closed to direct only a portion of the oil-enriched mixture to the turbine 204 in which case, the pressure imparted by the compressor 200 to gas received through the gas line 82 will be related to the amount that the valve 206 is closed. Preferably, the valve 206 is closed only enough to permit the compressor 200 to sufficiently compress gas for injection into the formation, and to thereby conserve pressure in the mixture in the oil-enriched mixture line 80.

By the use of the foregoing system shown in FIG. 6, formation pressure may be used to inexpensively compress gas at a well and inject the gas downhole without the necessity of sending the gas to a central compressor plant.

Figure 7:
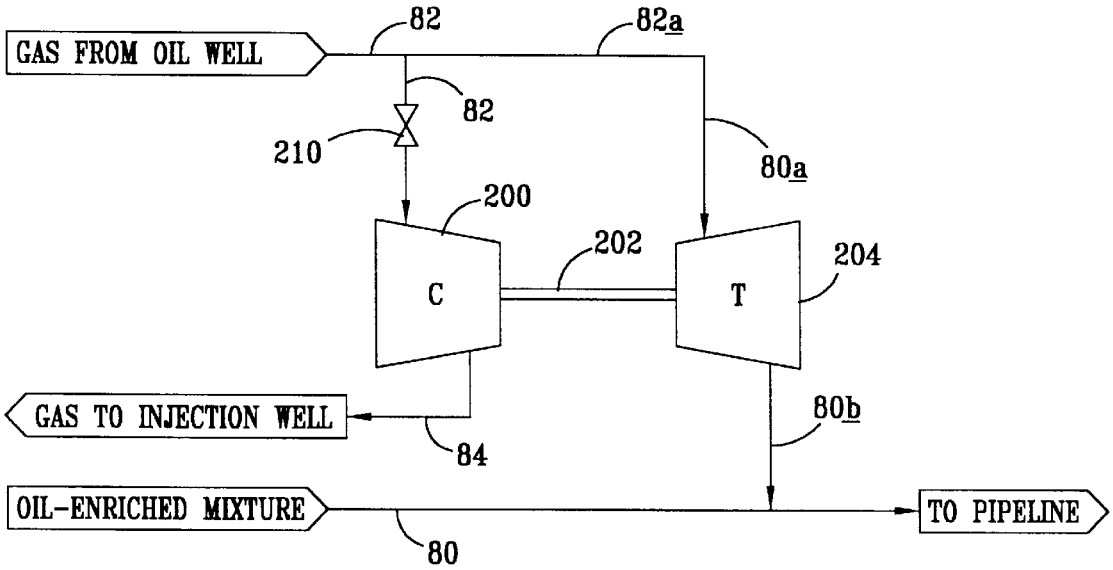
FIG. 7 is a schematic flow diagram of a surface portion of an alternate embodiment of the system of the present invention for compressing gas using energy from gas from an oil well.

In FIG. 7, an alternate embodiment of the system of FIG. 6 is shown in which the turbine 204 is driven by at least a portion of the gas taken off of the gas line 82 rather than at least a portion of the oil-enriched mixture taken off of the oil-enriched mixture line 80. To that end, a line 82*a* is connected for providing fluid communication between the gas line 82 and an inlet (not shown) to the turbine 204. A valve 210 is positioned in the gas line 82 downstream of the line 82*a* take-off for controlling the distribution of gas flow between the compressor 200 and the turbine 204. The line 80*b* is connected for providing fluid communication between an outlet (not shown) of the turbine 204 and the oil-enriched mixture line 80.

In the operation of the system shown in FIG. 7, the oil-enriched mixture flows through the oil-enriched mixture line 80 directly to a pipeline (not shown) which carries the mixture to downstream processing facilities which are considered to be well known in the art and will not be discussed. The valve 210 is actuated to regulate the flow of gas delivered from the gas line 82 to the turbine 204 and to the compressor 200 so that a proper flow balance may be maintained to permit the turbine to generate the power required to drive the compressor, thus controlling the operation thereof. Therefore, proper operation of the system of FIG. 7 requires that the valve 210 be neither fully open nor fully closed but rather that it be only partially open so that a portion of the gas in the gas line 82 be directed to the compressor 200 and a portion be directed through the line 82*a* to the turbine 204. Gas that does not flow through the valve 210 drives the turbine 204 which drives the compressor 200, and gas that flows through the valve 210 is compressed by the compressor 200. The proportion of gas that flows through the turbine 204 is preferably optimized to permit the turbine 204 to drive the compressor 200 to compress gas that flows through the valve 210 to the injection pressure, defined above. Gas is discharged from the turbine 204 through the line 80*b* to the oil-enriched mixture line 80 and to the pipeline and downstream processing facilities (not shown); and compressed gas is discharged from the compressor 200 into the gas return line 84 and into the injection zone 30 (FIGS. 2–5) as discussed above.

Figure 8:
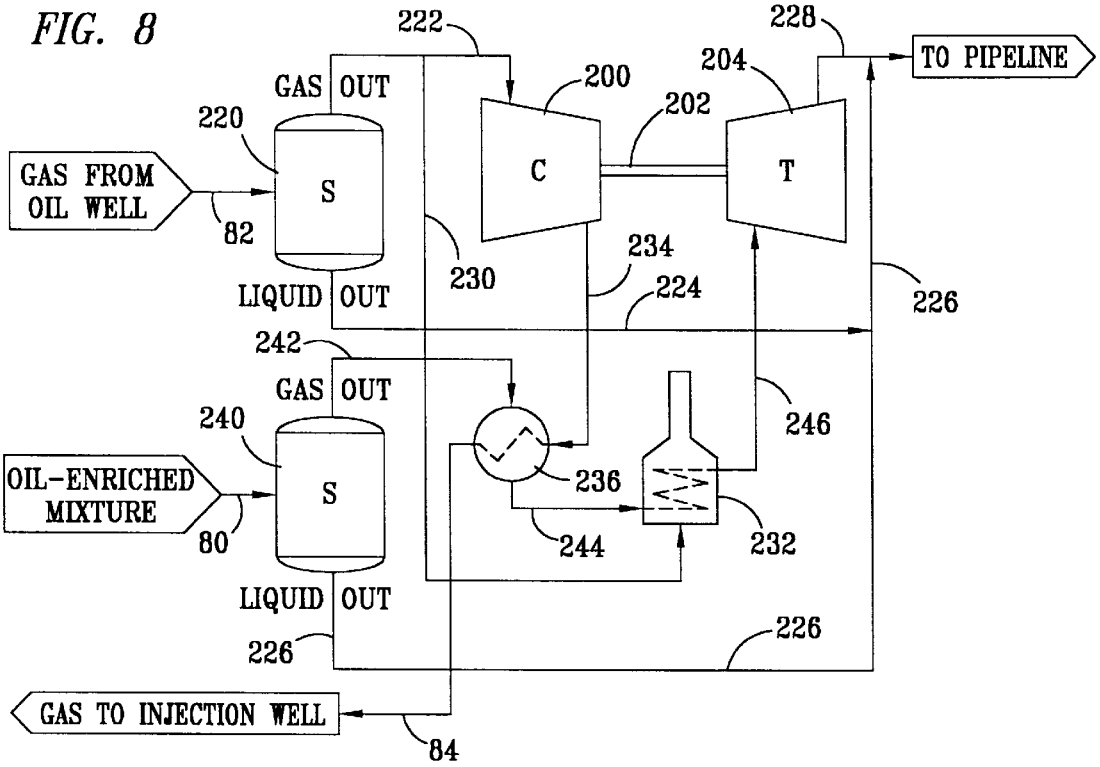
FIG. 8 is a schematic flow diagram of a surface portion of an alternate embodiment of the system of the present invention for compressing gas using a heater.

In FIG. 8, an alternate embodiment of the system of FIG. 6 is shown. The gas line 82 is connected for carrying gas to a separator 220, such as a suction scrubber or the like, configured for producing a separated gas and a separated liquid from the gas received through the gas line 82. A line 222 is connected to the separator 220 for carrying the separated gas produced by the separator 220 to the compressor 200, and a line 224 is connected to the separator 220 for carrying separated liquids produced by the separator 220 to a line 226, a line 228, and to a pipeline (not shown). A line 230 carries a portion of the gas in the line 222 to a heater such as a gas fired furnace 232 for combustion therein. While not shown, it is understood that suitable valves and the like are provided on the lines 222 and 230 for controlling gas flow distribution through those lines in a manner well known to those skilled in the art. A line 234 is connected for carrying compressed gas discharged from the compressor 200 to a gas-to-gas heat exchanger 236, and the gas return line 84 is connected for carrying the compressed gas from the heat exchanger 236 to an injection well as discussed above.

The oil-enriched mixture line 80 is connected for carrying the oil-enriched mixture to a separator 240, such as an expander suction separator or the like, configured for producing a separated gas and a separated liquid from the oil-enriched mixture received through the oil-enriched mixture line 80. A line 242 is connected to the separator 240 for carrying the separated gas produced by the separator 240 to the heat exchanger 236, and a line 226 is connected to the separator 240 for carrying separated liquids produced by the separator 240 to the line 228, and to the pipeline (not shown). A line 244 is connected to the heat exchanger 236 for carrying the separated gas produced by the separator 240 from the heat exchanger 236 to the furnace 232 for heating therein. A line 246 is connected for carrying the separated gas produced by the separator 240 and heated in the furnace 232 to an inlet (not shown) of the turbine 204. The line 228 is connected for carrying gas from the turbine 204 to the pipeline (not shown).

In the operation of the system shown in FIG. 8, the oil-enriched mixture flows through the oil-enriched mixture line 80 to the separator 240 which produces a separated gas and a separated liquid. The separated liquids (i.e., oil-enriched mixture) flow through the lines 226 and 228 to the pipeline and downstream processing facilities. The separated gas produced by the separator 240 flows through the line 242 to the heat exchanger 236, which transfers heat to the separated gas, through the line 244 to the furnace 232, which further heats the separated gas, and through the line 246 to the turbine 204. The heated gas drives the turbine 204, which then drives the compressor 200, and the gas is then discharged from the turbine through the line 228 to the pipeline (not shown). The heat transferred through the heat exchanger 236 and by the heater 232 to the gas that drives the turbine 204 should be sufficient to maintain a temperature of that gas, as it is discharged from the turbine, which is high enough to prevent paraffin's and/or hydrates from forming in the gas.

Gas in the gas line 82 flows to the separator 220 which produces from the gas separated gas and separated liquids. The separated liquids produced by the separator 220 flow through the lines 224, 226, and 228 to the pipeline (not shown) and to downstream processing facilities. A portion of the separated gas produced by the separator 220 flows through the line 222 to the compressor 200, and another portion of the separated gas flows through the lines 222 and 230 to the furnace 232. The gas carried to the furnace through the line 230 is combusted to generate heat to heat the gas which flows from the line 244 to the furnace. The gas carried through the line 222 to the compressor 200 is compressed to the injection pressure, defined above. Compressed gas is then discharged from the compressor 200 through the line 234 to the heat exchanger 236 which transfers heat from the compressed gas carried by the line 234 to the separated gas carried by the line 242. The compressed gas is then carried by the gas return line 84 to an injection well (not shown) for injection into the injection zone 30 (FIGS. 2–5) as discussed above.

While the furnace 232 is depicted as a gas fired furnace, any suitable heater may be used. For example, if electricity is available, an electric heater could also be utilized in lieu of the gas fired heater 232, and thereby conserve fuel gas and permit a greater quantity of gas to be compressed and injected into the injection zone 30 (FIGS. 2–5).

Figure 9:
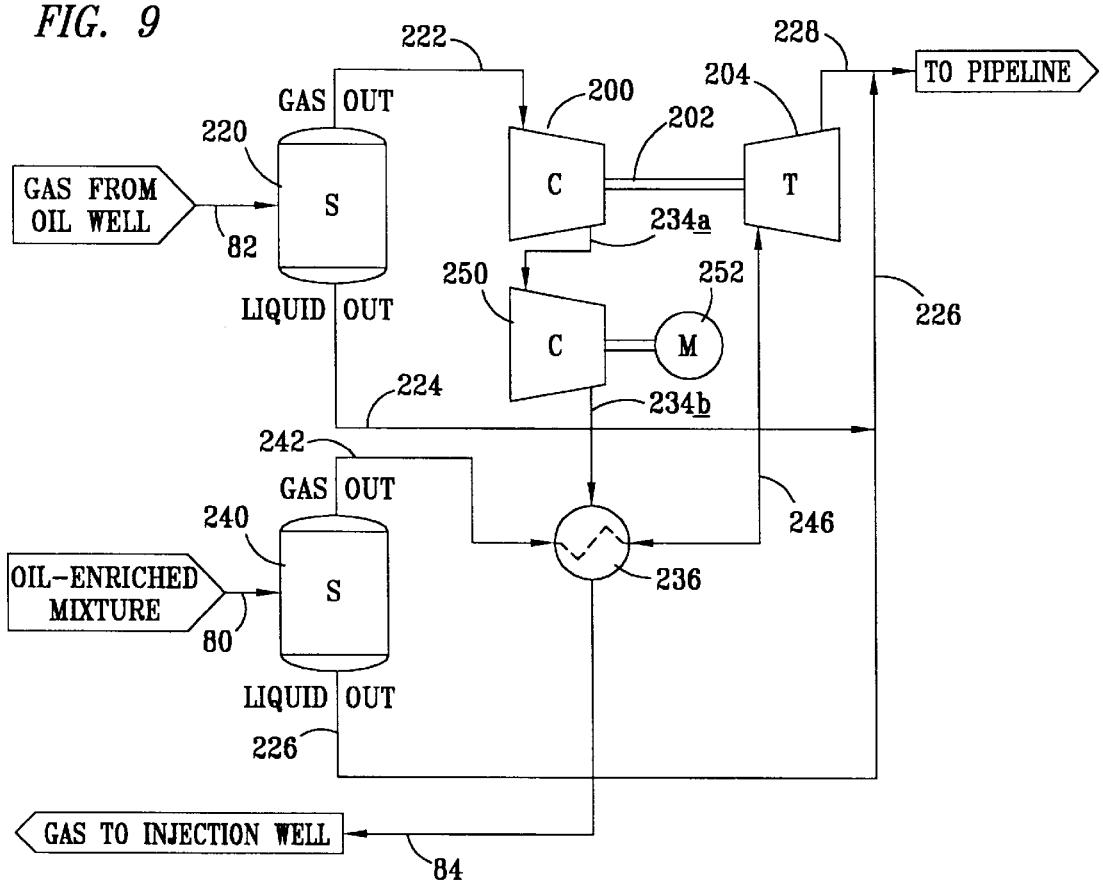
FIG. 9 is a schematic flow diagram of a surface portion of an alternate embodiment of the system of the present invention for compressing gas using energy derived from an external source.

In FIG. 9, an alternate embodiment of the system of FIG. 8 is shown wherein the compressor 200 is a first stage compressor. The line 234 (FIG. 8) is depicted in FIG. 9 as two lines 234*a* and 234*b*, and a suitable second stage compressor 250 is interposed between the lines 234*a* and 234*b* to further compress gas discharged from the compressor 200 before the gas is passed through the heat exchanger 236 and to the gas return line 84. The second stage compressor 250 is driven by any available suitable power source 252, such as an electrically powered motor, a gas fired turbine, a diesel engine, a turbine driven by fluids taken from available high pressure/output flowlines, or the like. Because the compressor 250 adds heat to the compressed gas, which heat is transferred via the heat exchanger 236 to the gas carried to the turbine 204, the furnace 232 utilized in the system of FIG. 8 is not utilized in the system of FIG. 9.

In the operation of the system shown in FIG. 9, the oil-enriched mixture flows through the oil-enriched mixture line 80 to the separator 240 which produces a separated gas and a separated liquid. The separated liquids (i.e., oil-enriched mixture) flow through the lines 226 and 228 to the pipeline and downstream processing facilities. The separated gas produced by the separator 240 flows through the line 242 to the heat exchanger 236, which transfers heat to the separated gas, and through the line 246 to the turbine 204. The heated gas drives the turbine 204, which then drives the compressor 200, and the gas is then discharged from the turbine through the line 228 to the pipeline (not shown). The heat transferred from the heat exchanger 236 to the gas that drives the turbine 204 should be sufficient to maintain a temperature of that gas, as it is discharged from the turbine, which is high enough to prevent paraffin's and/or hydrates from forming in the gas.

Gas in the gas line 82 flows to the separator 220 which produces from the gas separated gas and separated liquids. The separated liquids produced by the separator 220 flow through the lines 224, 226, and 228 to the pipeline and to downstream processing facilities (not shown). The separated gas produced by the separator 220 flows through the line 222 to the compressor 200, and through the line 234*a* to the second stage compressor 250. The compressors 200 and 250 compress the gas to the injection pressure, defined above, and, as a consequence of the compression, the gas is also heated. The second stage compressor 250 discharges the compressed and heated gas through the line 234*b* to the heat exchanger 236 which transfers heat from the compressed and heated gas to the separated gas produced by the separator 240. The compressed gas is then carried from the heat exchanger 236 by the gas return line 84 to an injection well (not shown) for injection into the injection zone 30 (FIGS. 2–5) as discussed above.

Figure 10:
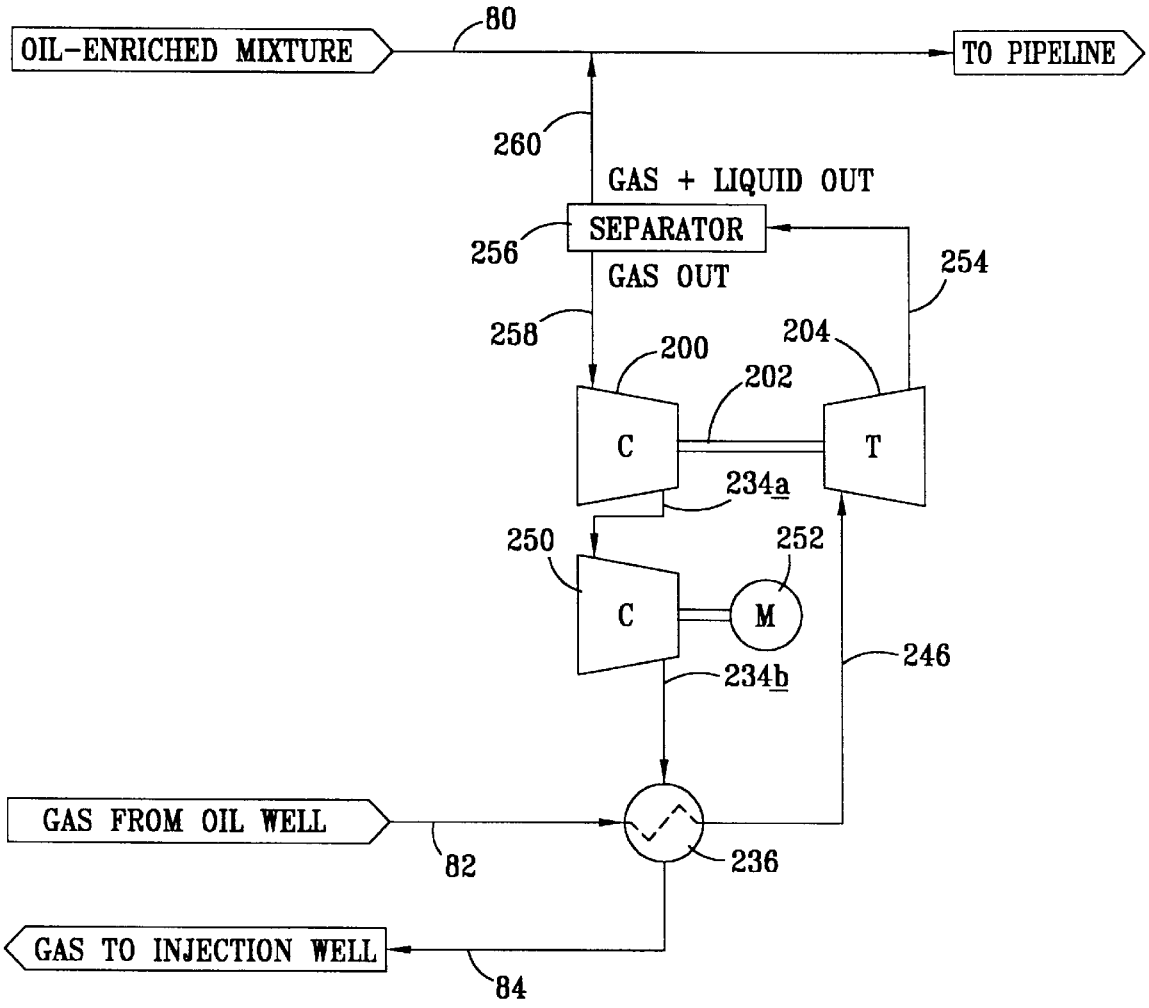
FIG. 10 is a schematic flow diagram of a surface portion of an alternate embodiment of the system of the present invention for compressing gas using energy derived from an external source.

In FIG. 10, an alternate embodiment of the system of FIG. 9 is shown in which a different separation technique is used. To that end, the oil-enriched mixture line 80 is connected directly to the pipeline (not shown) for carrying the oil-enriched mixture to downstream processing facilities (not shown). The gas line 82 is connected for carrying separated gas, directly to the heat exchanger 236, and the line 246 is connected for carrying the separated gas discharged from the heat exchanger to the inlet (not shown) of the turbine 204. The outlet (not shown) of the turbine 204 is connected through a line 254 for carrying gas discharged from the turbine to a separator 256, such as an auger separator, a cyclone separator, a rotary centrifugal separator, or the like, similar to the separator 70 described above with respect to FIGS. 2–5. The separator 256 is configured for separating at least a portion of the gas from the mixture of gas and liquids discharged from the turbine 204 to produce a separated gas to a line 258 and a separated mixture of liquids and gas to a line 260. The line 258 is connected for carrying the separated gas produced by the separator 256 to an inlet (not shown) of the compressor 200, and the line 260 is connected for carrying the separated mixture of liquids and gas produced by the separator 256 to the oil-enriched mixture line 80 for transport to the pipeline (not shown).

In the operation of the system shown in FIG. 10, the oil-enriched mixture flows through the oil-enriched mixture line 80 to the pipeline (not shown) which carries the mixture to downstream facilities for further processing. Separated gas is carried through the gas line 82 to the heat exchanger 236, which transfers heat to the separated gas, and through the line 246 to the turbine 204. The heated separated gas drives the turbine 204, which then drives the compressor 200, and the gas, with some condensate liquids, is then discharged from the turbine through the line 254 to the separator 256. The separator 256 separates at least a portion of the gas from the mixture of gas and liquids discharged from the turbine 204 to produce a separated gas to the line 258 and a separated mixture of liquids and gas to the line 260. The separated mixture of gas and liquids produced by the separator 256 is carried through the line 260 to the oil-enriched mixture line 80 which transports the mixture with the oil-enriched mixture to the pipeline and downstream processing equipment (not shown). The separated gas produced by the separator 256 is carried through the line 258 to and through the compressor 200, and through the line 234*a* to and through the second stage compressor 250. The compressors 200 and 250 are driven by the turbine 204 and the power source 252, respectively, to compress the gas to the injection pressure, defined above, and, as a consequence of the compression, the gas is also heated. The compressor 250 discharges the compressed and heated gas through the line 234*b* to the heat exchanger 236 which transfers heat from the compressed and heated gas to the separated gas carried by the gas line 82. The heat transferred through the heat exchanger 236 to the separated gas, carried by the gas line 82 and discharged from the heat exchanger to the line 246 to drive the turbine 204, should be sufficient to maintain a temperature of that gas, as it is discharged from the turbine, which is high enough to prevent paraffin's and/or hydrates from forming in the gas. The compressed gas is then carried from the heat exchanger 236 by the gas return line 84 to an injection well (not shown) for injection into the injection zone 30 (FIGS. 2–5) as discussed above.

In an alternate embodiment of the system shown in FIG. 10, the system may be configured without the second stage compressor 250 and the accompanying power source 252, and the lines 234*a* and 234*b* may be coupled to carry compressed gas from the compressor 200 to the heat exchanger 236. Operation of such an alternate embodiment would otherwise be substantially similar to the operation of the embodiment shown in FIG. 10.

The investment to install the system of the present invention in a plurality of wells to reduce the gas produced from a field is substantially less than the cost of providing additional separation and compression equipment at the surface. It also requires no fuel gas to drive the compression equipment since the pressure or combustion of the flowing fluids can be used for this purpose. It also permits the injection of selected quantities of gas from individual wells into a downhole injection zone, such as a gas cap, from which wells oil production had become limited by reason of the capacity of the lines or tubing to carry produced fluids away from the well, thereby permitting increased production from such wells. It can also make certain formations, which had previously been uneconomical to produce from, economical to produce from because of the ability to inject the gas downhole.

Having thus described the present invention by reference to certain of its preferred embodiments, it is noted that the embodiments disclosed are illustrative rather than limiting in nature and that many variations and modifications are possible within the scope of the present invention. Many such variations and modifications may be considered obvious and desirable by those skilled in the art based upon a review of the foregoing description of preferred embodiments.

Having thus described the invention, what is claimed is:

1. A method for increasing oil production from an oil well producing a mixture of oil and gas at an elevated pressure through a wellbore penetrating an oil-bearing formation containing an oil-bearing zone and an injection zone, the method comprising:

a) separating at least a portion of the gas from the mixture of oil and gas in an auger separator to produce a separated gas and an oil-enriched mixture;

b) utilizing energy from at least a portion of the mixture of oil and gas to compress at a surface at least a portion of the separated gas to produce a compressed gas having sufficient pressure to be injected into the injection zone;

c) injecting the compressed gas into the injection zone; and d) recovering at least a major portion of the oil-enriched mixture.

2. The method of claim 1 wherein the wellbore is a first wellbore and the step of injecting comprises injecting the compressed gas through a second wellbore into the injection zone.

3. The method of claim 1 further comprising the step of porting the separated gas into an annulus in the oil well for recovery of the separated gas at the surface.

4. The method of claim 1 wherein the step of injecting comprises injecting the compressed gas through the oil well into the injection zone.

5. The method of claim 1 wherein the at least a portion of the mixture of oil and gas is the oil-enriched mixture, and the step of utilizing energy further comprises:

driving a turbine with at least a portion of the oil-enriched mixture;

driving a compressor with the turbine; and compressing with the compressor the at least a portion of the separated gas to produce the compressed gas.

6. The method of claim 1 wherein the at least a portion of the mixture of oil and gas is the separated gas, and the step of utilizing energy further comprises:

driving a turbine with a first portion of the separated gas;

driving a compressor with the turbine; and compressing with the compressor a second portion of the separated gas to produce the compressed gas.

7. The method of claim 1 wherein the at least a portion of the mixture of oil and gas is the oil-enriched mixture, the separated gas is a first separated gas, and the step of utilizing energy further comprises:

separating gas from the oil-enriched mixture to produce a second separated gas;

driving a turbine with the second separated gas;

driving a compressor with the turbine; and compressing with the compressor at least a portion of the first separated gas to produce the compressed gas.

8. The method of claim 1 wherein the at least a portion of the mixture of oil and gas is the oil-enriched mixture, the separated gas is a first separated gas, and the step of utilizing energy further comprises:

separating gas from the oil-enriched mixture to produce a second separated gas;

heating the second separated gas to produce a heated second separated gas;

driving a turbine with the heated second separated gas;

driving a compressor with the turbine; and compressing with the compressor at least a portion of the first separated gas to produce the compressed gas.

9. The method of claim 1 wherein the at least a portion of the mixture of oil and gas is the oil-enriched mixture, the separated gas is a first separated gas, and the step of utilizing energy further comprises:

separating gas from the oil-enriched mixture to produce a second separated gas;

passing the second separated gas through a heat exchange relation with the compressed gas to produce a heated second separated gas;

driving a turbine with the heated second separated gas;

driving a compressor with the turbine; and compressing with the compressor at least a portion of the first separated gas to produce the compressed gas.

10. The method of claim 1 wherein the at least a portion of the mixture of oil and gas is the oil-enriched mixture, the separated gas is a first separated gas, and the step of utilizing energy further comprises:

separating gas from the oil-enriched mixture to produce a second separated gas;

driving a turbine with the second separated gas;

driving a first stage compressor with the turbine; and compressing at least a portion of the first separated gas with the first stage compressor and a second stage compressor to produce the compressed gas.

11. The method of claim 1 wherein the at least a portion of the mixture of oil and gas is the oil-enriched mixture, the separated gas is a first separated gas, and the step of utilizing energy further comprises:

separating gas from the oil-enriched mixture to produce a second separated gas;

passing the second separated gas through a heat exchange relation with the compressed gas to produce a heated second separated gas;

driving a turbine with the heated second separated gas;

driving a first stage compressor with the turbine; and compressing at least a portion of the first separated gas with the first stage compressor and a second stage compressor to produce the compressed gas.

12. The method of claim 1 wherein the at least a portion of the first mixture of oil and gas is the separated gas, and the step of utilizing energy further comprises:

driving a turbine with the separated gas and discharging from the turbine a product mixture of oil and gas;

driving a compressor with the turbine;

separating at least a portion of the gas from the product mixture of oil and gas to produce a product separated gas;

compressing the product separated gas with the compressor to produce the compressed gas.

13. The method of claim 1 wherein the at least a portion of the first mixture of oil and gas is the separated gas, and the step of utilizing energy further comprises:

driving a turbine with the separated gas and discharging from the turbine a product mixture of oil and gas;

driving a first stage compressor with the turbine;

separating at least a portion of the gas from the product mixture of oil and gas to produce a product separated gas; and compressing the product separated gas with the first stage compressor and a second stage compressor to produce the compressed gas.

14. The method of claim 1 wherein the at least a portion of the first mixture of oil and gas is the separated gas, and the step of utilizing energy further comprises:

driving a turbine with the separated gas and discharging from the turbine a product mixture of oil and gas;

driving a first stage compressor with the turbine;

separating at least a portion of the gas from the product mixture of oil and gas to produce a product separated gas;

compressing the product separated gas with the first stage compressor and a second stage compressor to produce the compressed gas; and heating the separated gas by passing the separated gas through a heat exchange relation with the compressed gas.

15. The method of claim 1 wherein the at least a portion of the first mixture of oil and gas is the separated gas, and the step of utilizing energy further comprises:

driving a turbine with the separated gas and discharging from the turbine a product mixture of oil and gas;

driving a compressor with the turbine;

separating at least a portion of the gas from the product mixture of oil and gas to produce a product separated gas;

compressing the product separated gas with the compressor to produce the compressed gas; and heating the product separated gas by passing the product separated gas through a heat exchange relation with the compressed gas.

16. A system for increasing the production of oil from an oil well producing a mixture of oil and gas at an elevated pressure through a wellbore penetrating a formation containing an oil-bearing zone and an injection zone, the system comprising:

an auger separator in fluid communication with the oil-bearing zone;

a turbine positioned at a surface of the earth and having an inlet in fluid communication with the separator for receiving fluids from the separator for driving the turbine; and a compressor drivingly connected to the turbine and positioned on the surface, the compressor having a gas inlet in fluid communication with a separated gas discharge outlet on the separator, the compressor further having a compressed gas discharge outlet in fluid communication through a passageway with the injection zone.

17. The system of claim 16 wherein the wellbore is a first wellbore and the passageway is a second wellbore.

18. The system of claim 16 wherein the wellbore is a first wellbore, the passageway is a second wellbore, and the separator is positioned in a tubing string in the first wellbore and is in fluid communication with an annulus formed between the tubing string and the first wellbore, which annulus is in fluid communication with the surface.

19. The system of claim 16 wherein the wellbore is a first wellbore, the passageway is a second wellbore, and the separator is positioned in a tubing string in the first wellbore and is in fluid communication with an annulus formed between the tubing string and the first wellbore, which annulus is in fluid communication with the surface, and the system further comprises a tubular member positioned in the tubing string, a first check valve positioned in the tubular member for permitting fluid flow from the tabular member to the injection zone, and a second check valve positioned in the tubular member for permitting fluid flow from the oil-bearing zone to the tubular member.

20. The system of claim 16 wherein the passageway extends through the wellbore.

21. The system of claim 16 further comprising:

a first tubing string positioned in the wellbore and having a lower tubing string portion in fluid communication with the injection zone and an upper tubing string portion in fluid communication with the surface;

a tubular member positioned in the first tubing string such that a first annulus is formed between the tubular member and the first tubing string, the separator being positioned within the tubular member in fluid communication through the tubular member with the oil-bearing zone;

a second tubing string positioned in the wellbore in fluid communication with the separated gas discharge outlet on the separator and a gas inlet of the compressor;

a first annulus defined between the first and second tubing strings, the first annulus being in fluid communication with an oil-enriched discharge outlet on the separator and with the surface;

a second annulus defined between the first tubing string and the casing, the second annulus being in fluid communication with the compressed gas discharge outlet;

a third annulus defined between first tubing string and the tubular member, the third annulus being in fluid communicator with the injection zone; and a hole formed in the first tubing string below the separator to permit fluid communication between the second annulus and the third annulus, such that the passageway extends from the compressed gas discharge outlet through the second passageway, through the hole, through the third annulus, and into the injection zone.

22. The system of claim 16 further comprising:

a tubing string positioned in the wellbore and having a lower tubing string portion in fluid communication with the injection zone and an upper tubing string portion in fluid communication with the separator;

a tubular member positioned in the tubing string with a first packer positioned between the tubular member and the tubing string and between the upper and lower tubing string portions, and with a second packer positioned between the tubular member and the wellbore, to provide fluid communication between the oil-bearing zone and the upper tubing portion; and a hole formed in a wall of the lower tubing string portion, the hole being in fluid communication with a first annulus defined between the tubing string and the wellbore and with a second annulus defined between the tubing string and the tubular member.

23. The system of claim 16 wherein the fluids received from the separator to drive the turbine comprise at least a portion of an oil-enriched mixture.

24. The system of claim 16 wherein the fluids received from the separator to drive the turbine comprise at least a portion of a separated gas.

25. The system of claim 16 wherein the fluids received from the separator to drive the turbine comprise a gaseous portion of an oil-enriched mixture.

26. The system of claim 16 wherein the separator is a first separator, the system further comprising:

a second separator having an inlet connected to receive an oil-enriched mixture from the first separator;

a heater having an inlet connected to receive from the second separator a gaseous portion of the oil-enriched mixture; and an inlet to the turbine connected to receive from the heater a heated gaseous portion of the oil-enriched mixture for driving the turbine.

27. The system of claim 16 wherein the separator is a first separator, the system further comprising:

a second separator having an inlet connected to receive an oil-enriched mixture produced from the first separator;

a heat exchanger having a first inlet connected to receive from the second separator a gaseous portion of the oil-enriched mixture, and a second inlet connected to receive a compressed gas from the compressor; and an inlet to the turbine connected to receive from the heat exchanger a heated gaseous portion of the oil-enriched mixture for driving the turbine.

28. The system of claim 16 wherein the separator is a first separator, the compressor is a first stage compressor, and the system further comprising:

a second separator having an inlet connected to receive an oil-enriched mixture from the first separator;

a second stage compressor connected to receive a first compressed gas from the first stage compressor; and an inlet to the turbine connected to receive from the second separator a gaseous portion of the oil-enriched mixture for driving the turbine.

29. The system of claim 16 wherein the separator is a first separator, the compressor is a first stage compressor, and the system further comprising:

a second separator having an inlet connected to receive an oil-enriched mixture from the first separator;

a second stage compressor connected to receive a first compressed gas from the first stage compressor;

a heat exchanger having a first inlet connected to receive from the second separator a gaseous portion of the oil-enriched mixture, and a second inlet connected to receive a compressed gas from the second stage compressor; and an inlet to the turbine connected to receive from the heat exchanger a heated gaseous portion of the oil-enriched mixture for driving the turbine.

30. The system of claim 16 wherein the separator is a first separator, the compressor is a first stage compressor, and the system further comprises:

a second stage compressor connected to receive a first compressed gas from the first stage compressor;

a heat exchanger having a first inlet connected to the separated gas discharge outlet on the first separator to receive the separated gas from the first separator, and a second inlet connected to receive a second compressed gas from the second stage compressor;

an inlet to the turbine connected to receive from the heat exchanger a heated separated gas for driving the turbine; and a second separator having an inlet connected to receive gas and liquids from the turbine and having a gas outlet in fluid communication with an inlet to the first compressor.

31. The system of claim 16 wherein the separator is a first separator and the compressor is a first stage compressor, the system further comprising:

a second stage compressor connected to receive a first compressed gas from the first stage compressor;

an inlet to the turbine connected to receive the separated gas from the first separator for driving the turbine; and a second separator having an inlet connected to receive gas from the turbine and having a gas outlet in fluid communication with an inlet to the first compressor.

32. The system of claim 16 wherein the separator is a first separator, the system further comprising:

a heat exchanger having a first inlet connected to the separated gas discharge outlet on the first separator to receive the separated gas from the first separator, and a second inlet connected to receive compressed gas from the compressor;

an inlet to the turbine connected to receive from the heat exchanger a heated separated gas for driving the turbine; and a second separator having an inlet connected to receive gas from the turbine and having a gas outlet in fluid communication with an inlet to the first compressor.

33. The system of claim 16 wherein the separator is a first separator, the system further comprising:

an inlet to the turbine connected to the separated gas discharge outlet on the first separator to receive the separated gas from the first separator for driving the turbine; and a second separator having an inlet connected to receive gas from the turbine and having a gas outlet in fluid communication with an inlet to the first compressor.

* * * * *